US009430927B2

(12) United States Patent
Yu et al.

(10) Patent No.: US 9,430,927 B2
(45) Date of Patent: Aug. 30, 2016

(54) ENVIRONMENTAL DETECTION SOUND SYSTEM

(71) Applicant: Global Plus Tech Inc., Taipei (TW)

(72) Inventors: Shine-fang Yu, Taipei (TW); Yi-Lin Tung, Taipei (TW)

(73) Assignee: GLOBAL PLUS TECH INC., Taipei (TW)

( * ) Notice: Subject to any disclaimer, the term of this patent is extended or adjusted under 35 U.S.C. 154(b) by 0 days.

(21) Appl. No.: 14/644,437

(22) Filed: Mar. 11, 2015

(65) Prior Publication Data

US 2016/0225245 A1 Aug. 4, 2016

(30) Foreign Application Priority Data

Feb. 3, 2015 (TW) ..... 104201755 U

(51) Int. Cl.

| | |
|---|---|
| ***G08B 21/00*** | (2006.01) |
| ***G08B 21/12*** | (2006.01) |
| ***G08B 3/10*** | (2006.01) |
| ***H04R 27/00*** | (2006.01) |

(52) U.S. Cl.

CPC ..... *G08B 21/12* (2013.01); *G08B 3/10* (2013.01); *H04R 27/00* (2013.01); *H04R 2420/07* (2013.01)

(58) Field of Classification Search

None

See application file for complete search history.

(56) References Cited

U.S. PATENT DOCUMENTS

| | | | | |
|---|---|---|---|---|
| 6,081,693 | A * | 6/2000 | Wicks | H04H 20/67 340/7.21 |
| 7,305,350 | B1 * | 12/2007 | Bruecken | G06Q 10/08 340/988 |
| 2008/0070522 | A1 * | 3/2008 | Marriott | H04H 20/38 455/150.1 |
| 2009/0287369 | A1 * | 11/2009 | Nielsen | G06Q 30/00 701/31.4 |
| 2010/0167687 | A1 * | 7/2010 | Morrey | G01S 5/0009 455/404.1 |
| 2013/0226369 | A1 * | 8/2013 | Yorio | G06F 17/00 701/1 |
| 2015/0031324 | A1 * | 1/2015 | Zentner | H04M 3/5116 455/404.2 |

* cited by examiner

*Primary Examiner* — Ojiako Nwugo

(74) *Attorney, Agent, or Firm* — McClure, Qualey & Rodack, LLP

(57) ABSTRACT

An environmental detection sound system includes a wireless communications unit, a system chip wirelessly communicating to an external operation device; an audio compilation unit, an output unit, a detector module and a data processing unit; wherein the system chip receives a control signal and a sound source signal, converts the sound source signal to a programming audio signal and then outputs the programming audio signal; the audio compilation unit receives the programming audio signal, converts the programming audio signal to an audio signal, and then outputs the audio signal; the output unit receives and plays back the audio signal; the detector module detects an environment and outputs a detection value; the data processing unit receives the detection value and produces a warning audio and a warning message to remind listeners to timely improve environmental conditions when the detection value exceeds a standard value, so as to maintain safety and health.

13 Claims, 2 Drawing Sheets

ENVIRONMENTAL DETECTION SOUND SYSTEM

CROSS-REFERENCES TO RELATED APPLICATIONS

This non-provisional application claims priority under 35 U.S.C. §119(a) on Patent Application No. 104201755 filed in Taiwan, R.O.C. on 2015/02/03, the entire contents of which are hereby incorporated by reference.

BACKGROUND

1. Technical Field

The present creation relates to the sound field, and more particularly to the sound having an environmental detection function.

2. Related Art

Audio enthusiasts usually set the sound equipment in a space, for example, bedrooms, acoustics rooms, etc., to achieve the best sound field listening effect through a variety of adjustment. Listening to music is a good way to relax in life, but usually during relaxation, it is easy to overlook the surrounding environment, for example, the light is too dark, temperature and humidity are too high, etc., which may directly or indirectly do harm to listeners in the environment, for example, fall damage caused by unclear sight and a sharp rise in the number of dust mites caused by temperature and humidity, leading to respiratory tract allergy and so on.

In the injuries, the slightest perceptible one is carbon monoxide, and when the concentration of carbon monoxide is too high, because a rate at which carbon monoxide is combined with hemoglobin in the blood is dozens of times that of oxygen, it may cause coma even death in closed environments. Therefore, it is necessary to solve the problem, so that listeners can respond in advance, to check, improve or leave the existing environment.

SUMMARY

The present disclosure mainly provides an environmental detection sound system, the environmental detection sound system including a system chip, a wireless communications unit, an audio compilation unit, an output unit, a detector module and a data processing unit.

The wireless communications unit is connected with the system chip, making the system chip wirelessly communicate with an external operation device. The operation device produces a sound source signal and a control signal to the system chip. The system chip receives the control signal and the sound source signal, and is driven by the control signal, converts the sound source signal to a programming audio signal and then outputs the programming audio signal. The audio compilation unit is electrically connected with the system chip, receives the programming audio signal, and converts the programming audio signal to an audio signal and then outputs the audio signal. The output unit receives and plays back the audio signal.

The detector module detects an environmental condition, such as brightness, temperature and humidity, pressure and concentration of volatile organic compounds (VOCs), and outputs at least one detection value. The data processing unit is electrically connected with the system chip and the detector module, receives and determines the at least one detection value, and when one of the at least one detection value exceeds a standard value, produces a warning audio and a warning message to the system chip, where, after the system chip converts the warning audio, the converted warning audio is converted by the audio compilation unit and played back by the output unit, and by using the system chip, the warning message is sent to the operation device by using the wireless communications unit.

The wireless communication includes at least one of infrared, Bluetooth, WIFI, Zeebee and near field communication. The operation device includes at least one of a mobile phone, a tablet computer and a wearable smart device.

In one embodiment, the data processing unit further produces an adjustment signal based on the at least one detection value, and transmits the adjustment signal to the system chip, so as to adjust the volume or equalizer value of the audio signal.

In one embodiment, a warning device is further included. The warning device is electrically connected with the data processing unit, and the data processing unit produces an enable signal when one of the at least one detection value exceeds the standard value, so as to start the warning device.

In one embodiment, an input module is further included. The input module includes a sound source unit and a control unit. The sound source unit provides a sound source signal, which can be implemented by a CD player, a USB flash drive, an SD card, a mobile phone, a tablet computer or the like. The control unit may be a control interface, available for start, stop, select and other operation functions.

The environmental detection sound system in the present disclosure can provide a warning for listeners in a sound environment in a manner that the detector module detects the environment when environmental conditions are not good, so that the listeners can immediately leave, check or improve the environment and maintain health and safety.

DETAILED DESCRIPTION

Figure 1:
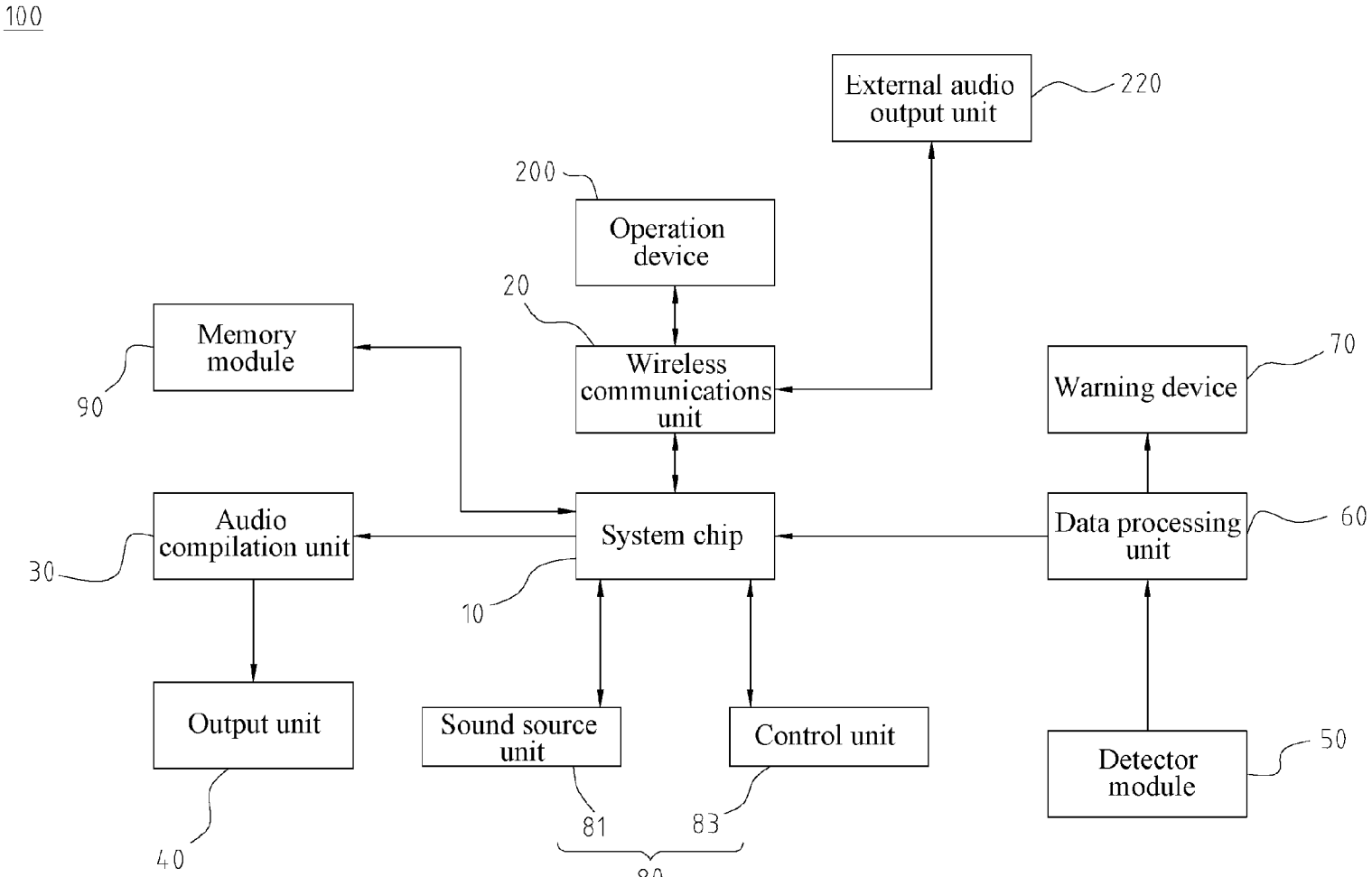
FIG. 1 is a schematic view of units of an environmental detection sound system according to the present invention.

Referring to FIG. 1, FIG. 1 is a schematic view of units of an environmental detection sound system according to the present invention. As shown in FIG. 1, the environmental detection sound system 100 according to the present disclosure includes a system chip 10, a wireless communications unit 20, an audio compilation unit 30, an output unit 40, a detector module 50 and a data processing unit 60. The system chip 10 wirelessly communicates with an external operation device 200 by using the wireless communications unit 20. The operation device 200 produces a sound source signal and a control signal. The operation device 200 is a mobile phone, a tablet computer, a wearable smart device or the like. The wireless communications unit 20 may make the system chip 10 wirelessly communicate with an external audio output unit 220 through at least one of infrared, Bluetooth, WIFI, Zeebee and near field communication.

After reading the sound source signal, the system chip 10 will distinguish the type of a sound source, and converts the sound source signal, for example, through coding or decoding, to a programming audio signal to be then transmitted to the audio compilation unit 30. The audio compilation unit 30 is electrically connected with the system chip 10, receives the programming audio signal, and after coding or decoding conversion, outputs an audio signal. The output unit 40 may be a combination of an amplifier and at least one loudspeaker, which receives and then plays back the audio signal.

In terms of an actual example, the audio signal may be a digital audio signal, for example, mp3, wma, etc., is decompressed, by the system chip 10, into original digital audio data, for example, a PCM format, and then is converted, by the audio compilation unit 30, for example, a Digital to Analog Converter (DAC), to an analog audio signal to be then output to the output unit 40.

The detector module 50 is connected with the data processing unit 60, used for detecting an environment where the environmental detection sound system 100 is, and outputting a detection value. The data processing unit 60 is electrically connected with the system chip 10, receives the detection value, compares the detection value with a standard value, and when the detection value exceeds the standard value, produces a warning audio and a warning message to the system chip 10, the warning audio is converted by the audio compilation unit 30 and played back by the output unit 40, and the warning message is sent to the operation device 200 by using the wireless communications unit 20. Further, the data processing unit 60 may further produce an adjustment signal based on the detection value, and transmit the adjustment signal to the system chip 10, so as to adjust the volume or equalizer value of the audio signal.

Furthermore, the environmental detection sound system 100 according to the present disclosure further includes a warning device 70. The warning device 70 is electrically connected with the data processing unit 60, and the data processing unit 60 produces an enable signal when the detection value exceeds the standard value, so as to start the warning device 70. The warning device 70 may be implemented by a warning light, a buzzer or the like.

Further, the environmental detection sound system 100 according to the present disclosure further includes an input module 80. The input module 80 includes a sound source unit 81 and a control unit 83. The sound source unit 81 may be implemented by a device where sound source signals are stored such as a CD player, a cassette player, a turntable player, a USB flash drive, an SD card, a mobile phone, a tablet computer or a wearable smart device. The control unit 83 may be a control interface, available for start, stop, select and other operation functions.

Further, the wireless communications unit 20 may further make the system chip 10 wirelessly communicate with an external audio output unit 220, and the external audio output unit 220 may be a wireless headset, a wireless speaker or the like.

Further, the environmental detection sound system 100 according to the present disclosure further includes a memory module 90, where the memory module 90 is electrically connected with the system chip 10, which may include at least one of a flash memory, a double data rate synchronous dynamic random access memory (DDRS-DRAM), a microdrive and a solid-state disk, used to store programs that convert the coded/decoded sound source signal, the programming audio signal and the warning audio, so as to speed up access to the sound source signal, the programming audio signal and the warning audio.

Figure 2:
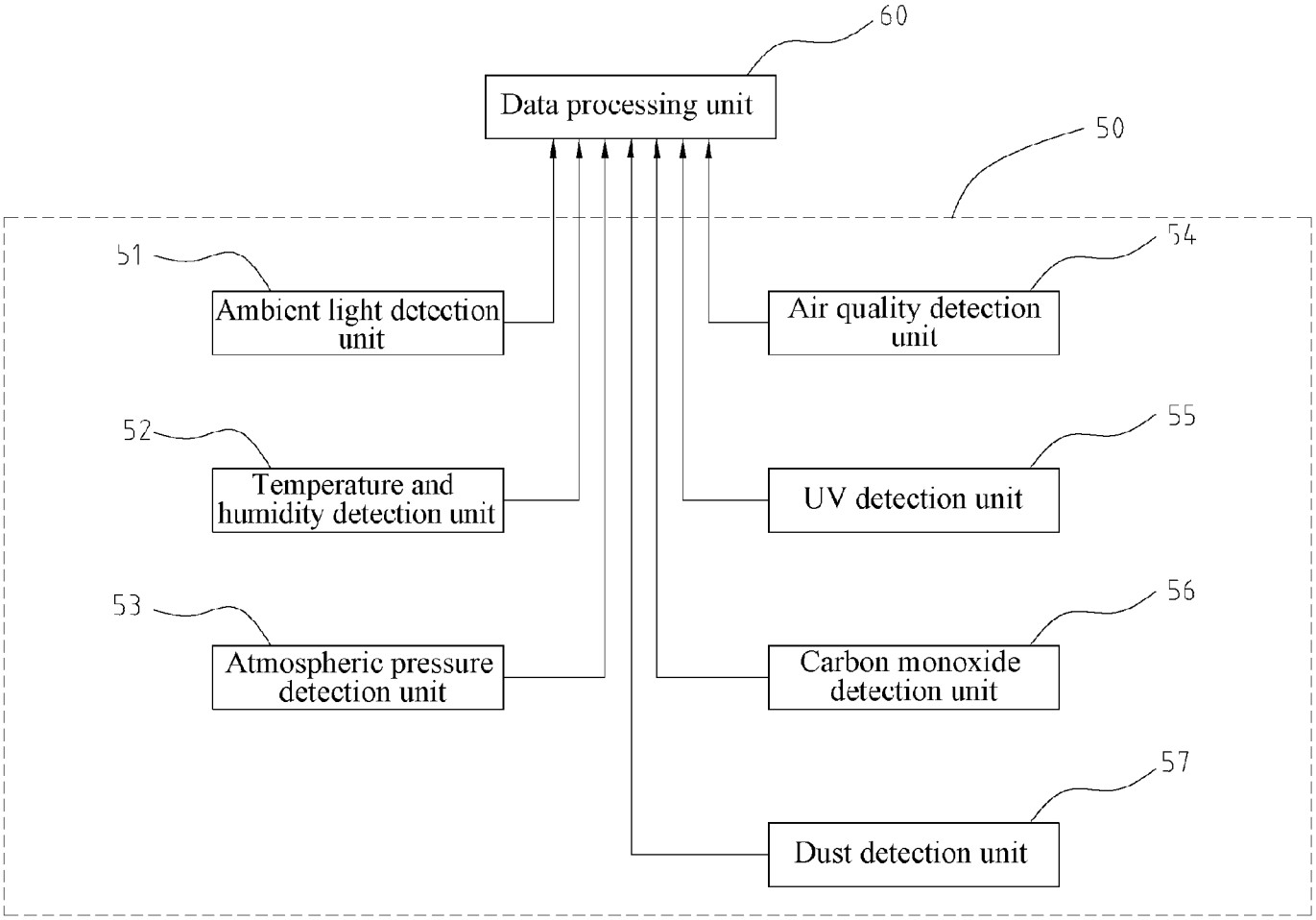
FIG. 2 is a schematic view of units of the detector module in FIG. 1.

Referring to FIG. 2, FIG. 2 is a schematic view of units of the detector module in FIG. 1. As shown in FIG. 2, the detector module 50 includes an ambient light detection unit 51, a temperature and humidity detection unit 52, an atmospheric pressure detection unit 53, an air quality detection unit 54, a UV detection unit 55, a carbon monoxide detection unit 56 and a dust detection unit 57, where the ambient light detection unit 51, the temperature and humidity detection unit 52, the atmospheric pressure detection unit 53, the air quality detection unit 54, the UV detection unit 55, the carbon monoxide detection unit 56 and the dust detection unit 57 are electrically connected with the data processing unit 60 respectively.

The ambient light detection unit 51, the temperature and humidity detection unit 52 and the atmospheric pressure detection unit 53 detect light brightness, temperature and humidity and pressure in an environment respectively, which may mainly produce a warning audio or a warning message when the value exceeds the standard value, for example, when the temperature and humidity exceed 50% and 28 degrees or the light brightness is too low. The system chip 10 transmits the warning audio and the warning message to the operation device 200 for presentation by using the wireless communications unit 20. Further, the data processing unit 60 may produce an adjustment signal based on the detection value, and transmit the adjustment signal to the system chip 10, so as to adjust the volume or equalizer value of the audio signal, so that listeners in the environment can achieve comfortable listening effects.

The air quality detection unit 54, the UV detection unit 55, the carbon monoxide detection unit 56 and the dust detection unit 57 detect air quality, for example, concentration of VOCs, UV light intensity, carbon monoxide concentration and dust concentration in the environment. These directly relate to health of the listeners in the environment, therefore, the data processing unit 60 is mainly used to determine whether they exceed the standard value, and then produces a warning audio or a warning message to inform the listeners.

A user of the operation device 200 may also read values in the existing environment by using the wireless communications unit 20, for example, concentration of VOCs, UV light intensity, carbon monoxide concentration and dust concentration, and actively organize the environment, so as to be suitable for special demands, for example, babies, old men, respiratory allergic patients, and the like.

A main technical feature of the environmental detection sound system according to the present disclosure lies in combining the detector module with the sound system, to detect environmental conditions at any time, which warns the listeners in the environment when the environmental conditions are not good, to timely check, improve or leave the environmental conditions, so as to maintain safety and health.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An environmental detection sound system, comprising:

a wireless communications unit wirelessly communicating with an external operation device, the external operation device producing a sound source signal and a control signal;

a system chip wirelessly communicating with the external operation device by using the wireless communications unit, receiving the control signal and the sound source signal, and driven by the control signal, converting the sound source signal to a programming audio signal and then outputting the programming audio signal;

an audio compilation unit electrically connected with the system chip, receiving the programming audio signal, and converting the programming audio signal to an audio signal and then outputting the audio signal;

an output unit, receiving and playing back the audio signal;

a detector module, detecting an environmental condition, and outputting at least one detection value; and a data processing unit electrically connected with the system chip and the detector module, receiving and determining the at least one detection value, and when one of the at least one detection value exceeds a standard value, producing a warning audio and a warning message to the system chip, wherein, after the system chip converts the warning audio, the converted warning audio is converted by the audio compilation unit and played back by the output unit, and by using the system chip, the warning message is sent to the external operation device by using the wireless communications unit.

2. The environmental detection sound system according to claim 1, wherein the audio compilation unit is a digital-to-analog converter.

3. The environmental detection sound system according to claim 1, wherein the data processing unit further produces an adjustment signal based on the at least one detection value, and transmits the adjustment signal to the system chip, so as to adjust the volume or equalizer value of the audio signal.

4. The environmental detection sound system according to claim 1, further comprising an input module, the input module comprising a sound source unit and a control unit, the sound source unit producing a sound source signal, and the control unit producing a control signal to drive the system chip.

5. The environmental detection sound system according to claim 4, wherein the sound source unit stores sound source signals, and is at least one of a CD player, a cassette player, a turntable player, a USB flash drive, an SD card, a mobile phone, a tablet computer and a wearable smart device.

6. The environmental detection sound system according to claim 1, further comprising a warning device, wherein the warning device is electrically connected with the data processing unit, and the data processing unit produces an enable signal when one of the at least one detection value exceeds the standard value, so as to start the warning device.

7. The environmental detection sound system according to claim 6, wherein the warning device is at least one of a warning light and a buzzer.

8. The environmental detection sound system according to claim 1, wherein the wireless communications unit makes the system chip wirelessly communicate with the external operation device through at least one of infrared, Bluetooth, WIFI, Zeebee and near field communication.

9. The environmental detection sound system according to claim 1, wherein the external operation device is at least one of a mobile phone, a tablet computer and a wearable smart device.

10. The environmental detection sound system according to claim 1, wherein the wireless communications unit further wirelessly communicates with an external audio output unit.

11. The environmental detection sound system according to claim 1, wherein the detector module comprises at least one of an ambient light detection unit, a temperature and humidity detection unit, an atmospheric pressure detection unit, an air quality detection unit, a UV detection unit, a carbon monoxide detection unit and a dust detection unit, wherein the ambient light detection unit, the temperature and humidity detection unit, the atmospheric pressure detection unit, the air quality detection unit, the UV detection unit, the carbon monoxide detection unit and the dust detection unit are electrically connected with the data processing unit respectively and used to detect light brightness, temperature and humidity, pressure, concentration of volatile organic compounds (VOCs), UV light intensity, carbon monoxide concentration and dust concentration in an environment respectively, and output the at least one detection value to the data processing unit.

12. The environmental detection sound system according to claim 1, further comprising a memory module electrically connected with the system chip, used to store programs that convert the sound source signal, the programming audio signal and the warning audio, so as to speed up access to the sound source signal, the programming audio signal and the warning audio.

13. The environmental detection sound system according to claim 12, wherein the memory module comprises at least one of a flash memory, a double data rate synchronous dynamic random access memory (DDRSDRAM), a microdrive and a solid-state disk.

* * * * *